US007000627B1

(12) United States Patent
Johnson

(10) Patent No.: US 7,000,627 B1
(45) Date of Patent: Feb. 21, 2006

(54) TOILET SAFETY VALVE

(76) Inventor: Donn Charles Johnson, 10 Pinecrest Ct., Stafford, VA (US) 22554-3932

( * ) Notice: Subject to any disclaimer, the term of this patent is extended or adjusted under 35 U.S.C. 154(b) by 0 days.

(21) Appl. No.: 11/000,910

(22) Filed: Dec. 2, 2004

(51) Int. Cl.
*E03D 11/02* (2006.01)

(52) U.S. Cl. ..... 137/1; 137/412; 137/624.11; 4/427

(58) Field of Classification Search ..... 137/1, 137/412, 624.11; 4/427
See application file for complete search history.

(56) References Cited

U.S. PATENT DOCUMENTS

| | | | | |
|---|---|---|---|---|
| 362,963 | A | 5/1887 | Hopper | |
| 927,706 | A | 7/1909 | Beardsley et al. | |
| 3,880,190 | A | 4/1975 | Boss | |
| 3,928,874 | A * | 12/1975 | Albertson | 4/427 |
| 4,119,116 | A | 10/1978 | Johnson et al. | |
| 4,195,374 | A | 4/1980 | Morris et al. | |
| 4,249,565 | A | 2/1981 | Brust | |
| 4,589,435 | A | 5/1986 | Aldrich | |
| 4,876,751 | A | 10/1989 | Van Meter | |
| 5,036,553 | A * | 8/1991 | Sanderson | 4/313 |
| 5,940,899 | A * | 8/1999 | Mankin et al. | 4/427 |
| 6,058,519 | A * | 5/2000 | Quintana | 4/427 |
| 6,367,096 | B1 | 4/2002 | Quintana | |
| 6,543,479 | B1 | 4/2003 | Coffey et al. | |
| 6,543,480 | B1 | 4/2003 | Mazzei et al. | |
| 6,671,893 | B1 * | 1/2004 | Quintana et al. | 4/427 |
| 6,684,757 | B1 | 2/2004 | Petersen | |
| 6,708,722 | B1 | 3/2004 | Goodenough | |
| 6,934,977 | B1 * | 8/2005 | Quintana et al. | 4/427 |

FOREIGN PATENT DOCUMENTS

| | | |
|---|---|---|
| GB | 2 054 907 | 2/1981 |

* cited by examiner

*Primary Examiner*—Kevin Lee
(74) *Attorney, Agent, or Firm*—Stephen Christopher Swift; Swift Law Office

(57) ABSTRACT

An apparatus and method for ensuring that the flow of water to a toilet tank is shut off. The first preferred embodiment of the invention combines a conventional float mechanism to shut off the flow of water to a toilet tank when full, with a timer mechanism to shut off the flow of water if the float mechanism fails. There is also a manual override to shut off the flow of water if both the float mechanism and the timer mechanism fail. In the second preferred embodiment, the float mechanism is in the toilet bowl, and shuts off the flow of water when the water level rises in the bowl above a certain level after the toilet is flushed, with the timer mechanism again backing up the float mechanism. In the third preferred embodiment, there are two float mechanisms, one in the tank and the other in the toilet bowl.

20 Claims, 4 Drawing Sheets

TOILET SAFETY VALVE

BACKGROUND OF THE INVENTION

1. Field of the Invention

The present invention relates to an apparatus and method for preventing a toilet tank from overflowing.

2. Description of the Prior Art

There have been numerous prior inventions for devices to shut off the flow of water or other fluid automatically, but none that are equivalent to the present invention.

U.S. Pat. No. 362,963, issued on May 17, 1887, to Henry S. Hopper, discloses a water tank valve with a float, which automatically shuts off the flow of water into the tank when it is full. The instant invention is distinguishable, in that it has a timed safety shut-off.

U.S. Pat. No. 927,706, issued on Jul. 13, 1909, to Thomas E. Beardsley and Patrick E. Carmody, discloses a faucet that shuts off automatically within a certain time after it is opened, entirely by mechanical means. The instant invention is distinguishable, in that it shuts off the flow of water into a tank, not from a faucet, and it uses electricity, rather than being entirely mechanical.

U.S. Pat. No. 3,880,190, issued on Apr. 29, 1975, to Gary R. Boss, discloses a timed fluid valve, which operates entirely by mechanical means. The instant invention is distinguishable, in that it uses electricity.

U.S. Pat. No. 4,119,116, issued on Oct. 10, 1978, to Philip P. Johnson and William T. Lampman, discloses an apparatus for filling a receptacle, with a mechanically controlled valve element controlled by a float, and an electrically controlled valve element controlled by a timer. The instant invention is distinguishable in that it also has a manual override.

U.S. Pat. No. 4,195,374, issued on Apr. 1, 1980, to Earl L. Morris, Walter V. Hafner and Theodore J. Sally, discloses a plumbing fixture overflow limiter, designed to prevent a toilet bowl from overflowing. The instant invention is distinguishable in that it is designed to prevent a toilet tank from overflowing.

U.S. Pat. No. 4,249,565, issued on Feb. 10, 1981, to Russell E. Brust, discloses a timed water shut off system, with a sensing valve that detects the commencement of the flow of water and activates a timer that closes a timer switch causing a solenoid operated valve to close to stop the flow of water after a certain time. The flow of water will continue to be shut off until the timer switch is opened manually. The instant invention is distinguishable, in that it has a manually operated valve that closes (rather than opens) the solenoid operated valve, and its valve can also be closed by the operation of a float.

U.S. Pat. No. 4,589,435, issued on May 20, 1986, to Donald C. Aldrich, discloses a solenoid operated valve that automatically shuts off the flow of water after a certain time. A timer may be reset by a hand switch. The hand switch may be set to turn the timer off, so that the flow of water will not be interrupted. The instant invention is distinguishable, in that it the valve may be closed by the operation of a float.

U.S. Pat. No. 4,876,751, issued on Oct. 31, 1989, to Larry W. Van Meter, discloses an automatic toilet flush control system, in which the flushing of the toilet is timed, rather than the refilling of the tank, as in the instant invention.

U.S. Pat. No. 6,367,096, issued on Apr. 9, 2002, to Richard Quintana, discloses a toilet leak detector and overflow control, which prevents a toilet bowl from overflowing, rather than preventing the tank from overflowing, as in the instant invention.

U.S. Pat. No. 6,543,479, issued on Apr. 8, 2003, to John B. Coffey and Walter G. Kaiser, discloses a water monitoring system that automatically shuts off the water supply after a predetermined period of time. There is one valve that can be operated either manually or by means of a solenoid. The instant invention is distinguishable, in that in it the valve may be closed by the operation of a float.

U.S. Pat. No. 6,543,480, issued on Apr. 8, 2003, to Dom Mazzei and Frank Pieters, discloses a laundry faucet valve and timer control, having inlets and outlets for hot and cold water being supplied to an appliance such as a washing machine. The flow of water is shut off by a valve mechanism between the inlets and outlets after a certain period of time. The instant invention is distinguishable, in that in it the valve may be closed by the operation of a float.

U.S. Pat. No. 6,684,757, issued on Feb. 3, 2004, to Bradley Frank Petersen, discloses a gas grill propane monitor, having a timing device that is activated once the grill is turned on, which will automatically cut off the flow of gas after a certain time set by the user. There is no float-operated shutoff mechanism, as in the instant invention.

U.S. Pat. No. 6,708,722, issued on Mar. 23, 2004, to Robert A. Goodenough, discloses a water flow control system, which automatically shuts off the water supply to a building after a certain time. Again, there is no float-operated shutoff mechanism, as in the instant invention.

British Patent No. 2 054 907, published on Feb. 18, 1981, inventor Giorgio Tranzocchi, discloses a device for controlling the water level in the tub of a laundry washing machine, including a timer which closes a valve after a certain time. The instant invention is distinguishable, in that it is designed to control the water level in a toilet tank, and uses a float-operated shutoff mechanism.

None of the above inventions and patents, taken either singly or in combination, is seen to describe the instant invention as claimed.

SUMMARY OF THE INVENTION

The first preferred embodiment of the present invention combines a conventional float mechanism to shut off the flow of water to a toilet tank when it is full, with a timer mechanism to shut off the flow of water if the float mechanism fails. There is also a manual override to shut off the flow of water if both the float mechanism and the timer mechanism fail. In the second preferred embodiment, the float mechanism is in the toilet bowl, and shuts off the flow of water when the water level rises in the bowl above a certain level after the toilet is flushed, in order to prevent water from overflowing the bowl, with the timer mechanism shutting off the flow of water if the float mechanism fails. In the third preferred embodiment, there are two float mechanisms, one in the tank and the other in the bowl.

Accordingly, it is a principal object of the invention to provide an apparatus and method for preventing water damage to a home caused by water overflowing or leaking from a toilet tank.

It is another object of the invention to provide an apparatus and method for preventing water damage to a nonresidential building caused by water overflowing or leaking from a toilet tank.

It is a further object of the invention to provide an apparatus and method for preventing water damage to a home caused by water overflowing from a toilet bowl.

Still another object of the invention is to provide an apparatus and method for preventing water damage to a nonresidential building caused by water overflowing from a toilet bowl.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a safety valve apparatus for a toilet tank and a method of preventing a toilet tank from overflowing using the apparatus.

Figure 1:
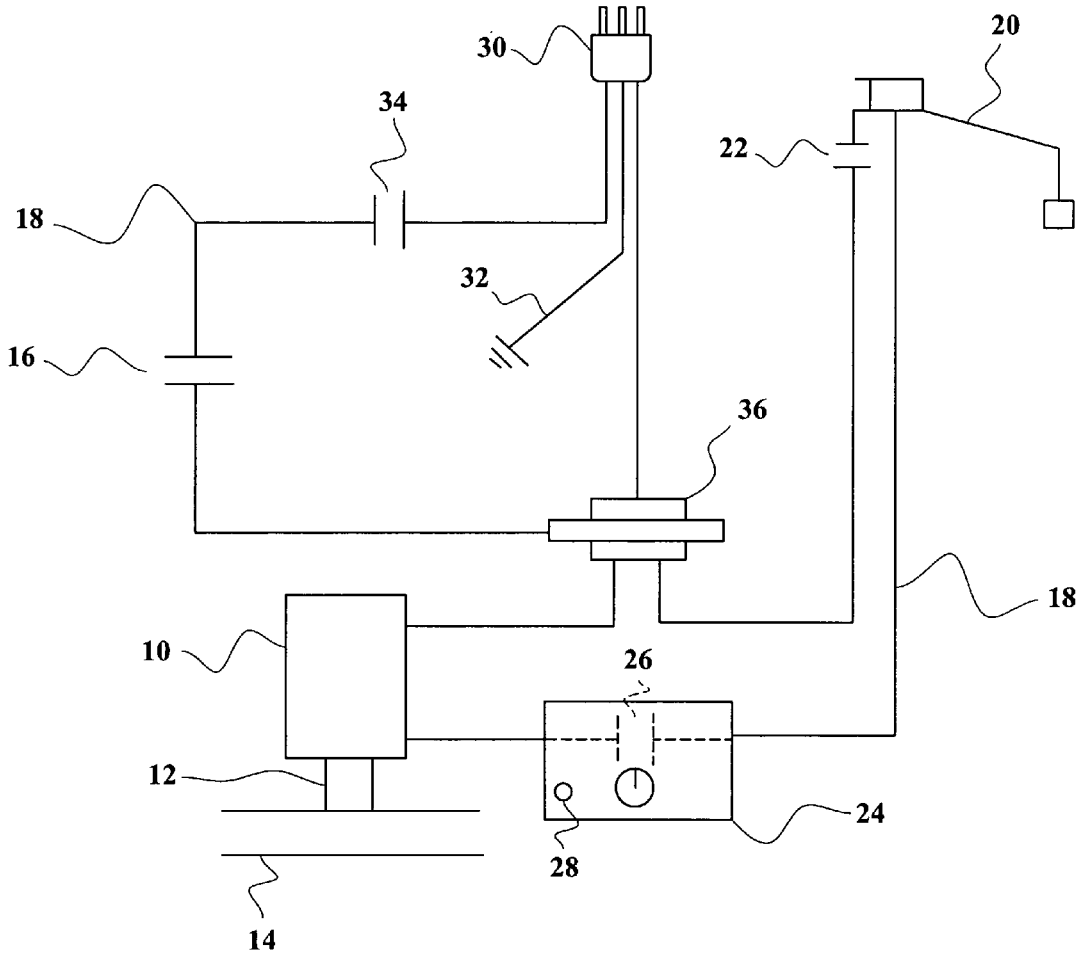
FIG. 1 is a schematic view of the invention.

FIG. 1 is a schematic overview of the invention. A solenoid 10 operates a valve 12 that when closed blocks the flow of water through water supply pipe 14 to the tank of a toilet. The solenoid operated valve is biased toward the closed position that it has when de-energized. The solenoid is energized when electricity flows through it, and it then opens the valve, allowing water to flow through the pipe into the tank. Valve switch 16 closes an electric circuit 18 when the toilet is flushed, causing the solenoid operated valve to open and thus allowing water to flow through the pipe to refill the toilet tank. The toilet may be flushed when a lever handle is pushed, or when a signal is received from an electric eye (not shown in the drawings). Float mechanism 20, which in the first preferred embodiment of the invention is in the toilet tank, rises as the tank refills, and causes float switch 22 to open the electric circuit when the water in the tank reaches a certain level, cutting off the supply of electricity to the solenoid, thus causing the solenoid operated valve to close and cut off the flow of water to the tank. In the event that the float switch is not closed after a set period of time, e.g., if the tank is broken or leaking, or the float mechanism is malfunctioning, timing mechanism 24 causes timer switch 26 to open, thus preventing water from overflowing the tank, even if the float mechanism fails. When the electric circuit is opened (e.g., by the float switch) the timing mechanism is automatically reset to zero. When the timer switch is opened, indicator light 28 comes on to indicate that the float mechanism has failed. The invention may be plugged into the household (or other building) power supply using three-pronged plug 30 with ground wire 32. (Alternatively, the invention may be permanently hard wired to the power supply, e.g., if required by a code.) Toggle switch 34 may be used to turn the invention on or off when it is plugged in. 120 volt current from a wall socket is stepped down to 24 volts by transformer 36.

Figure 2:
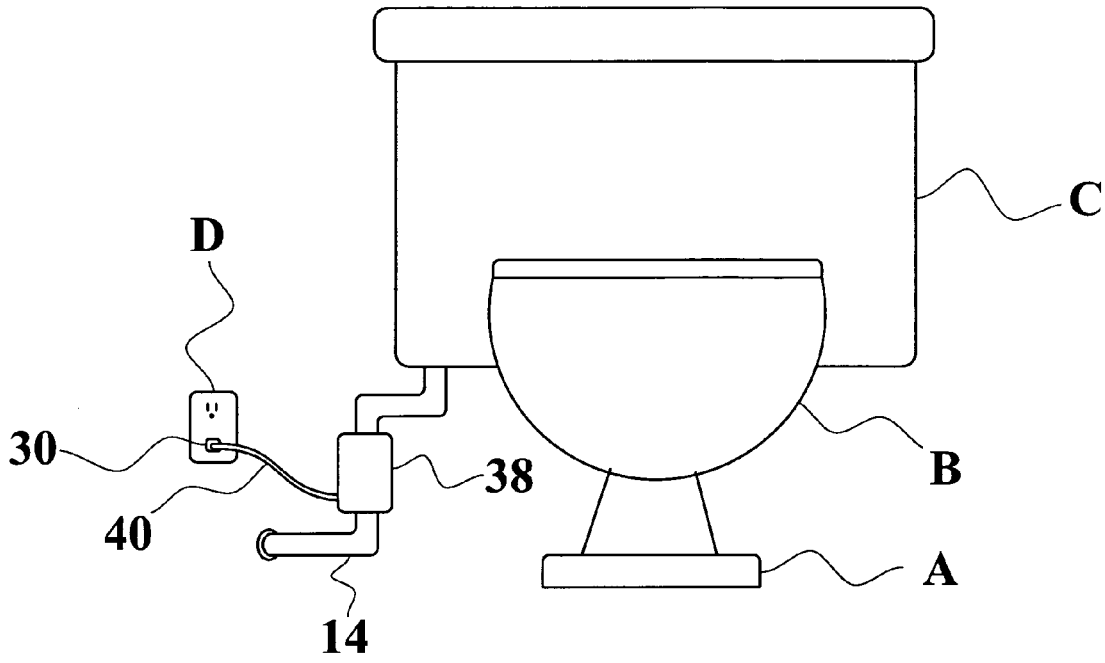
FIG. 2 is an environmental view of the invention.

FIG. 2 is an environmental view of the invention, showing toilet A with bowl B and tank C, and the invention's housing 38 attached to water supply pipe 14. Electric power is supplied to the invention from wall socket D through plug 30 and grounded power cord 40. The invention may be part of the original design of the toilet, or it may be retrofitted to an existing toilet.

Figure 3:
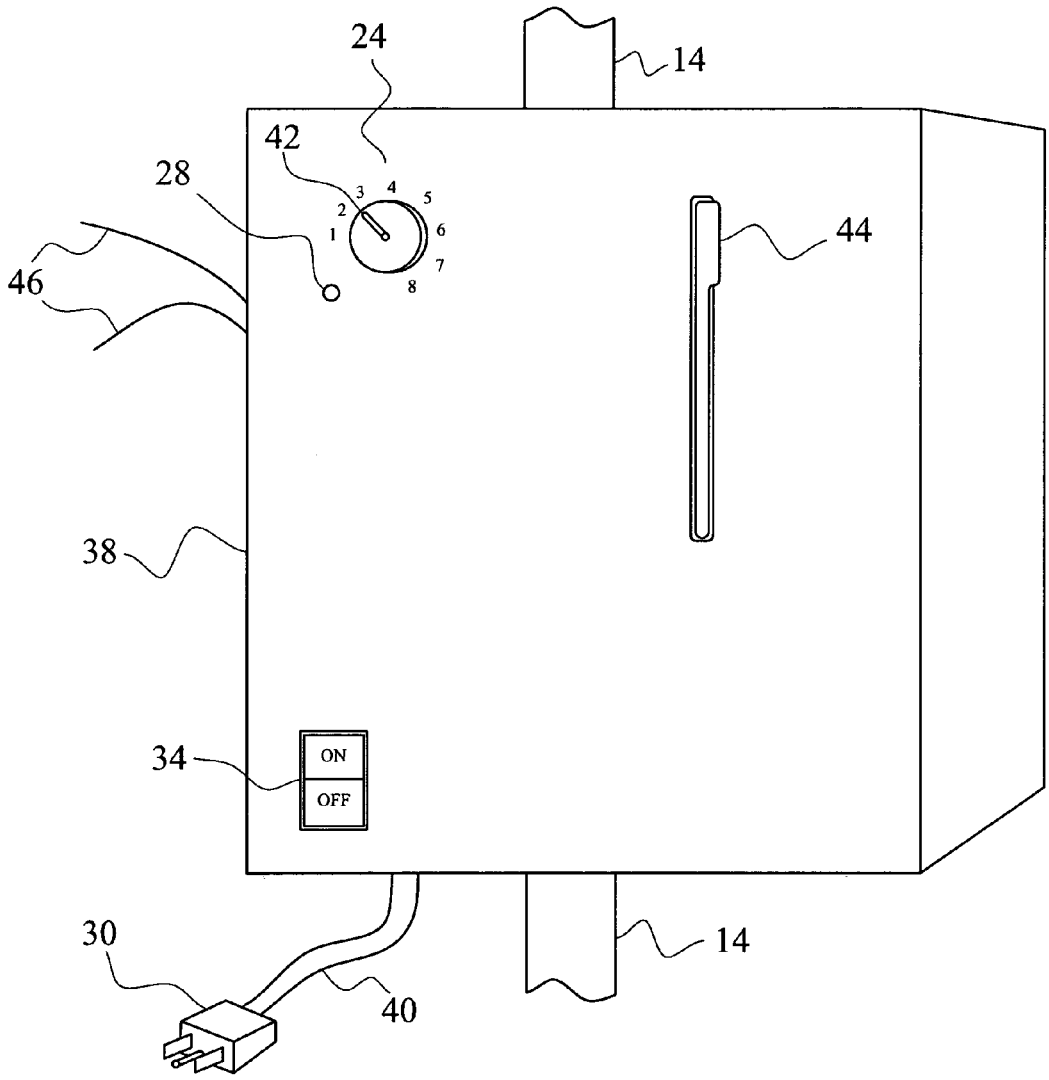
FIG. 3 is a detail view of part of the invention covered by its housing.
Figure 4:
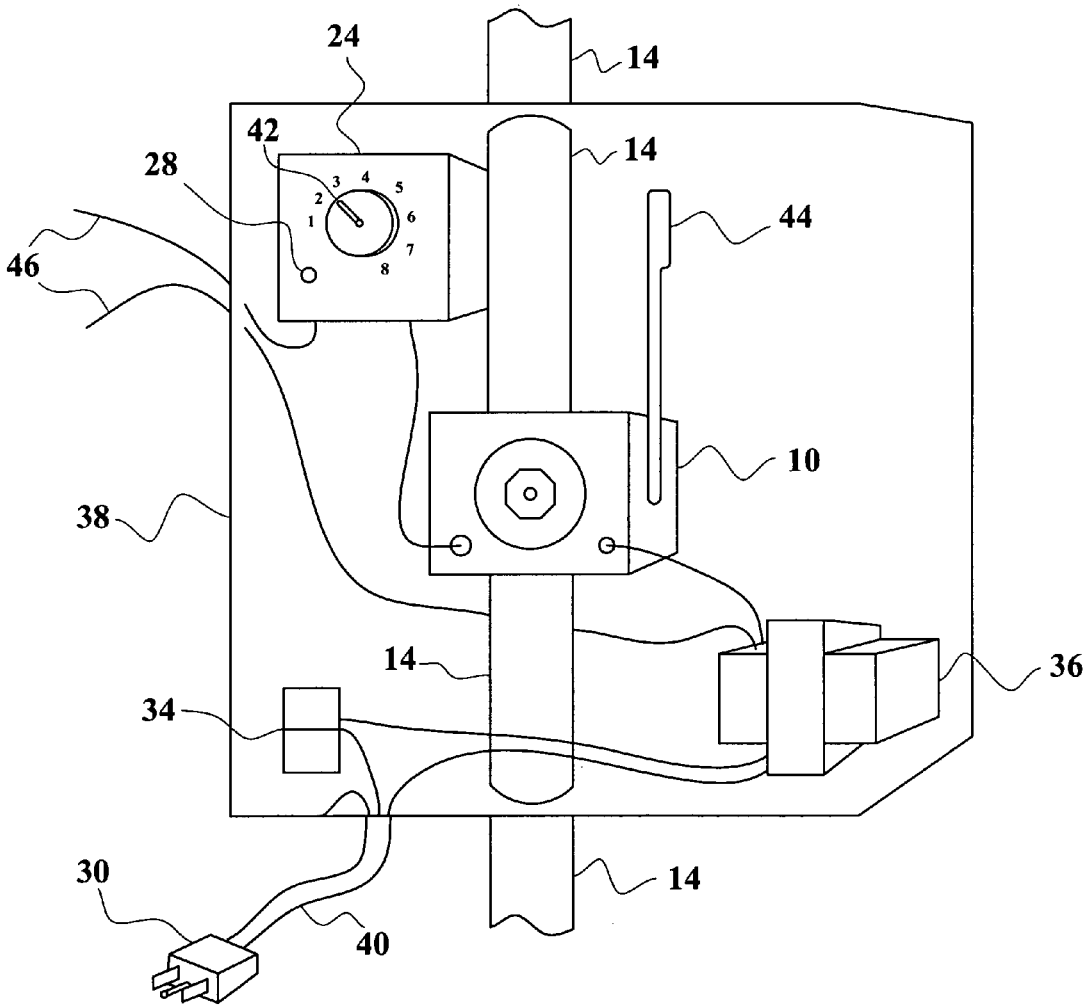
FIG. 4 is a detail view of part of the invention, with part of its housing removed to expose the underlying structure.

FIG. 3 is a front perspective view showing the invention's housing 38. FIG. 4 a front perspective view, with part of the housing removed to expose the underlying structure. Manually adjustable dial 42 can be used to set the maximum period time that water will be allowed to flow into the tank before the timing mechanism causes the flow to be shutoff. Manual override lever 44 can be pulled down to cause an override switch within the solenoid (not shown in the drawings) to open the electric circuit, thus de-energizing the solenoid, closing the valve, and preventing water from overflowing the tank, even if both the float mechanism and the timing mechanism fail to do so. The manual override may be pushed up to open the valve, in case of power failure or malfunction. Wires 46 connect to the float mechanism.

A second preferred embodiment is the same as the first preferred embodiment described above, except that the float mechanism is in the toilet bowl rather than the tank. The float mechanism rises in the toilet bowl as the water level increases there after the toilet is flushed, causing the float switch to open, thus opening an electric circuit supplying electricity to the solenoid, causing the solenoid operated valve to close, and shutting off the flow of water through the pipe to prevent the toilet bowl from overflowing. After a set period of time, if the float mechanism does not turn off the flow of electric current, the timing mechanism opens the electric circuit, thus de-energizing the solenoid, closing the valve, and shutting off the flow of water to prevent the bowl from overflowing.

In a third preferred embodiment, there are float mechanisms in both the tank and the toilet bowl, of which the one in the tank works like the float mechanism in the first preferred embodiment, and the one in the bowl works like the float mechanism in the second preferred embodiment. Each float mechanism has its own float switch in the third preferred embodiment.

It is to be understood that the present invention is not limited to the embodiments described above, but encompasses any and all embodiments within the scope of the following claims.

I claim:

1. A safety valve for a toilet tank, comprising:

a solenoid operated valve in a water supply pipe to a toilet tank, which is biased toward a closed position in which the flow of water through the pipe is cut off, but moves to an open position, allowing water to flow through the pipe, when electricity flows through the solenoid;

a valve switch that closes an electric circuit supplying electricity to the solenoid when a toilet is flushed, causing the solenoid operated valve to open and allowing water to flow through the pipe to refill the toilet tank;

a float mechanism in the toilet tank that rises as the tank refills, and causes a float switch to open the electric circuit when the water in the tank reaches a certain level, cutting off the supply of electricity to the solenoid, causing the valve to close and cut off the flow of water to the tank; and a timing mechanism that causes a timer switch to open the electric circuit after a set period of time, when the float mechanism does not do so, thus preventing water from overflowing the tank, even if the float mechanism fails.

2. The safety valve for a toilet tank according to claim 1, including:

a manual override, that can cause an override switch to open the electric circuit, thus de-energizing the solenoid, closing the valve, and preventing water from overflowing the tank, even if both the float mechanism and the timing mechanism fail to do so.

3. The safety valve for a toilet tank according to claim 2, wherein the manual override can also be used to open the valve.

4. The safety valve for a toilet tank according to claim 3, including an indicator light that comes on when the timing mechanism has caused the switch to open the electric circuit, to indicate that the float mechanism has failed.

5. The safety valve for a toilet tank according to claim 4, wherein the set period of time for the timing mechanism is manually adjustable by turning a dial.

6. The safety valve for a toilet tank according to claim 5, wherein the valve switch closes the electric circuit when a lever handle is turned to flush the toilet.

7. The safety valve for a toilet tank according to claim 5, wherein the valve switch closes the electric circuit when a signal is received from an electric eye.

8. The safety valve for a toilet tank according to claim 5, including:

a second float mechanism in a toilet bowl, that, when water rises above a certain level in the toilet bowl after the toilet is flushed, causes a second float switch to open the electric circuit.

9. A safety valve for a toilet tank, comprising:

a solenoid operated valve in a water supply pipe to a toilet tank, which is biased toward a closed position in which the flow of water through the pipe is cut off, but moves to an open position, allowing water to flow through the pipe, when electricity flows through the solenoid;

a valve switch that closes an electric circuit supplying electricity to the solenoid when a toilet is flushed, causing the solenoid operated valve to open and allowing water to flow through the pipe to refill the toilet tank;

a float mechanism in the toilet bowl that rises as the water level in the bowl rises after the toilet is flushed, and causes a float switch to open the electric circuit when the water in the bowl reaches a certain level, cutting off the supply of electricity to the solenoid, causing the valve to close and cut off the flow of water to the bowl; and a timing mechanism that causes a timer switch to open the electric circuit after a set period of time, when the float mechanism does not do so, thus preventing water from overflowing the bowl, even if the float mechanism fails.

10. The safety valve for a toilet tank according to claim 9, including:

a manual override, that can cause an override switch to open the electric circuit, thus de-energizing the solenoid, closing the valve, and preventing water from overflowing the bowl, even if both the float mechanism and the timing mechanism fail to do so.

11. The safety valve for a toilet tank according to claim 10, wherein the manual override can also be used to open the valve.

12. The safety valve for a toilet tank according to claim 11, wherein the set period of time for the timing mechanism is manually adjustable by turning a dial.

13. A method of preventing a toilet tank from overflowing, comprising the steps of:

closing a valve switch when a toilet is flushed, the valve switch closing an electric circuit supplying electricity to a solenoid, causing a valve operated by the solenoid to open and allow water to flow through a pipe to refill a toilet tank;

opening a float switch by a float mechanism in the toilet tank that rises as the tank refills, and causes the float switch to open the electric circuit when the water in the tank reaches a certain level, cutting off the supply of electricity to the solenoid, causing the valve to close and cut off the flow of water to the tank; and if the float mechanism fails to open the switch, opening a timer switch by a timing mechanism that causes the timer switch to open the electric circuit after a set period of time.

14. The method of preventing a toilet tank from overflowing according to claim 13, including the step of:

if the both the float mechanism and the timing mechanism fail to open the electric circuit, opening the electric circuit by a manual override that opens an override switch, thus closing the valve.

15. The method of preventing a toilet tank from overflowing according to claim 14, wherein the manual override can also be used to open the valve.

16. The method of preventing a toilet tank from overflowing according to claim 15, including the step of:

activating an indicator light when the timing mechanism has caused the timer switch to open the electric circuit, to indicate that the float mechanism has failed.

17. The method of preventing a toilet tank from overflowing according to claim 16, wherein the set period of time for the timing mechanism is manually adjustable by turning a dial.

18. The method of preventing a toilet tank from overflowing according to claim 17, wherein the valve switch closes the electric circuit when a lever handle is turned to flush the toilet.

19. The method of preventing a toilet tank from overflowing according to claim 17, wherein the valve switch closes the electric circuit when a signal is received from an electric eye.

20. The method of preventing a toilet tank from overflowing according to claim 17, including:

a second float mechanism in a toilet bowl, that, when water rises beyond a certain level in the toilet bowl after the toilet is flushed, causes a second valve switch to open the electric circuit.

* * * * *